United States Patent [19]

Johnson et al.

[11] Patent Number: 4,918,705

[45] Date of Patent: Apr. 17, 1990

[54] FURNACE ENCLOSURE HAVING A CLEAR VIEWPATH

[75] Inventors: Neil A. Johnson, Schenectady; Russell S. Miller, Ballston Spa, both of N.Y.; Gordon B. Hunter, Loveland, Ohio

[73] Assignee: General Electric Company, Schenectady, N.Y.

[21] Appl. No.: 376,094

[22] Filed: Jul. 6, 1989

[51] Int. Cl.[4] ..... H05B 7/00

[52] U.S. Cl. ..... 373/10; 373/12; 373/49; 373/104; 373/25; 219/121.54; 219/130.01

[58] Field of Search ..... 373/10, 12, 25, 49, 373/104, 105, 102; 219/130.01, 124.34, 121.86, 121.54

[56] References Cited

U.S. PATENT DOCUMENTS

| | | | |
|---|---|---|---|
| 3,371,140 | 2/1968 | Wynne | 373/70 |
| 4,435,818 | 3/1984 | Stenzel et al. | 373/104 |
| 4,484,059 | 11/1984 | Lillquist | 219/130.01 |

*Primary Examiner*—Roy N. Envall, Jr.

*Attorney, Agent, or Firm*—Paul E. Rochford; James C. Davis, Jr.; James Magee, Jr.

[57] ABSTRACT

A clear optical path is provided in a furnace in which high intensity top surface heating is carried out. The path extends through a viewport to the interior of the furnace chamber. The path extends to a clear metal mirror surface and from the mirror surfaced to other portions of the furnace chamber which are not viewable directly through the viewport.

12 Claims, 1 Drawing Sheet

FURNACE ENCLOSURE HAVING A CLEAR VIEWPATH

CROSS REFERENCE TO RELATED APPLICATIONS

The present invention relates generally to the subject matter of Ser. No. 390052, filed Aug. 7, 1989, and to Ser. No. 376,095, filed Jul. 6, 1989. The texts of these cross referenced applications are included herein by reference.

BACKGROUND OF THE INVENTION

The present invention relates generally to a scheme by which a furnace used to melt process alloys at high temperature employing Plasma Arc Melting (PAM) or Electron Beam Melting (EBM) can be visually observed. More particularly, it relates to a scheme for providing and preserving an optical path into the furnace chamber while the melt processing is in progress and permitting viewing of almost the entire interior of the furnace chamber by a clean surfaced mirror.

It has been found that particulate matter which is generated from the melt surface of PAM or EBM specimens tends to deposit on viewports and associated apparatus used for monitoring the melt processing of these specimens either visually or optically. Such deposits of particulate material interfere with visual observation used for process monitoring and also interferes with quantitative infrared temperature measurements used for process control as well as with other optical techniques, such as mirror viewing, used either for process control or monitoring of the processing taking place within the furnace. For example, visual observation of the melt pool level is sometimes necessary in order to monitor the level for processing purposes.

Prior approaches employed for dealing with optical path window fowling of this nature have included a variety of mechanical and optical accessories. Some of these have included, for example, movable films, wipers, brushes, pinhole lenses, mirrors, and a variety of shutters. However, none of these means has been satisfactory on an extended use basis.

For example, with regard to movable films, these films have not proven reliable and when the film fails it presents a possibility of introducing foreign material into the melt chamber. Further, such films are not always suitable either in terms of optical quality or in terms of spectral response where instrumented observation is employed.

In another mode, wipers as well as brushes are employed periodically to clean the interior surface of a viewport or of an associated mirror. However, this leaves the optical properties of these windows and mirrors time dependent and, for the most part, unpredictable. Further, from such wiping or brushing, the deposits are freed from the window or mirror surface but ma be caused to fall into the chamber and into the melt to cause contamination of the melt.

In another mode, shutters are employed both of a manual and of a motorized character. However, the shutters only reduce the rate of deposition and do not preclude the deposition from occurring. Further, shutters introduce moving parts and seals and this introduction can compromise the furnace atmosphere. The use of shutters means that the presence or absence of the window or mirror deposits remains time dependent and, further, there is no continuous viewing when the shutter mechanism is in operation.

Conventional gas purged windows or mirrors have not been effective in preventing deposition. This is because the conventional gas purge scheme involves the high flow of gas past a window and the high flow induces eddy currents which cause a backflow of the contaminant particulate matter thus resulting in an irregular deposition of material on the window interior. The nonuniform deposition actually increases the problem of using such viewports.

A successful window is described in the copending application Serial No.390,052 filed Aug. 7, 1989. This mechanism requires a gas flow and such flow is suitable for many furnacing operations. However, for electron beam melting a good vacuum must be maintained in the chamber. Such a vacuum cannot be maintained where purge gas is used or is needed. Further, the mean free path of gas particles is very large at low pressure and a very long interception tube may be required where a viewport or mirror is used in connection with a gas purge as described in the copending application.

Some of the problems of keeping a mirror surface free of contamination from deposited vaporous or particulate matter are particularly acute. The real advantages of use of a mirrored surface in connection with a viewport is that it permits much broader zones within the furnace enclosure to be viewed. In other words, the optical path available to a viewport is quite limited to what lies directly ahead of the transparent element through which the viewing is done. However, it is frequently desirable to see into portions of the furnace chamber which are not optically aligned with the viewport. Efforts to provide reflective surfaces have suffered from the same problems as afflict the viewports themselves. Occlusion of solids, and particularly finely divided solids which contain significant oxygen levels clouds the surface and presents need for accessory equipment or operations as described above to keep them clean.

Moreover, the viewport is usually remote from the point where high levels of heat are applied and the fine particulate matter is generated. A mirror surface is likely to be closer to the source of contaminant and for this reason is more likely to become contaminated.

We have now devised a means for maintaining the optical path through a viewport in an apparatus which employs high intensity heating such as heating through PAM or through EBM or similar high intensity means and where this high intensity heating results in the formation of particulate matter which develops into a cloud or fog within a furnacing chamber.

The apparatus of the present invention is particularly suitable for use in connection with the high intensity top heating of a metal bath as by electron beam or plasma heating. Such high intensity surface heating causes generation of substantial amounts of metal vapor and/or very fine particles. It is toward the reduction in fowling and contamination of optical paths within the furnace chamber because of vapors and fine particles toward which the subject invention is directed.

BRIEF STATEMENT OF THE INVENTION

Accordingly, one object of the present invention is to provide a clear optical path to much of the interior of a furnace enclosure in which fine particulate matter is generated.

Another object is to provide a method of keeping a mirror in a furnace enclosure clear.

Another object is to provide a furnace apparatus capable of being viewed over essentially the entire interior although fine particulate matter is produced therein.

Another object is to provide a mirror capable of remaining comparatively clear within a furnace enclosure in which contaminant particulate matter is being produced.

Other objects will be in part apparent and in part pointed out hereinafter.

In one of its broader aspects, these and other objects of the present invention may be achieved by first providing a furnace enclosure for high intensity heating of metals as by electron beam and/or plasma heating techniques. A viewport is provided through a furnace wall. Within the furnace enclosure a metal mirror surface is provided. Means for articulation of the mirror surface permit providing an optical path between the viewport and much of the furnace interior. A determination is made of whether the charge on particles of a cloud formed in said chamber by high intensity heating is positive or negative. A charge is established on the metal mirror surface which is the same as the charge on the particles in order to repel deposit of particulate matter on the mirror surface.

BRIEF DESCRIPTION OF THE DRAWINGS

The description of the invention which follows will be understood with greater clarity if reference is made to the accompanying drawings in which.

DETAILED DESCRIPTION OF THE INVENTION

Figure 1:
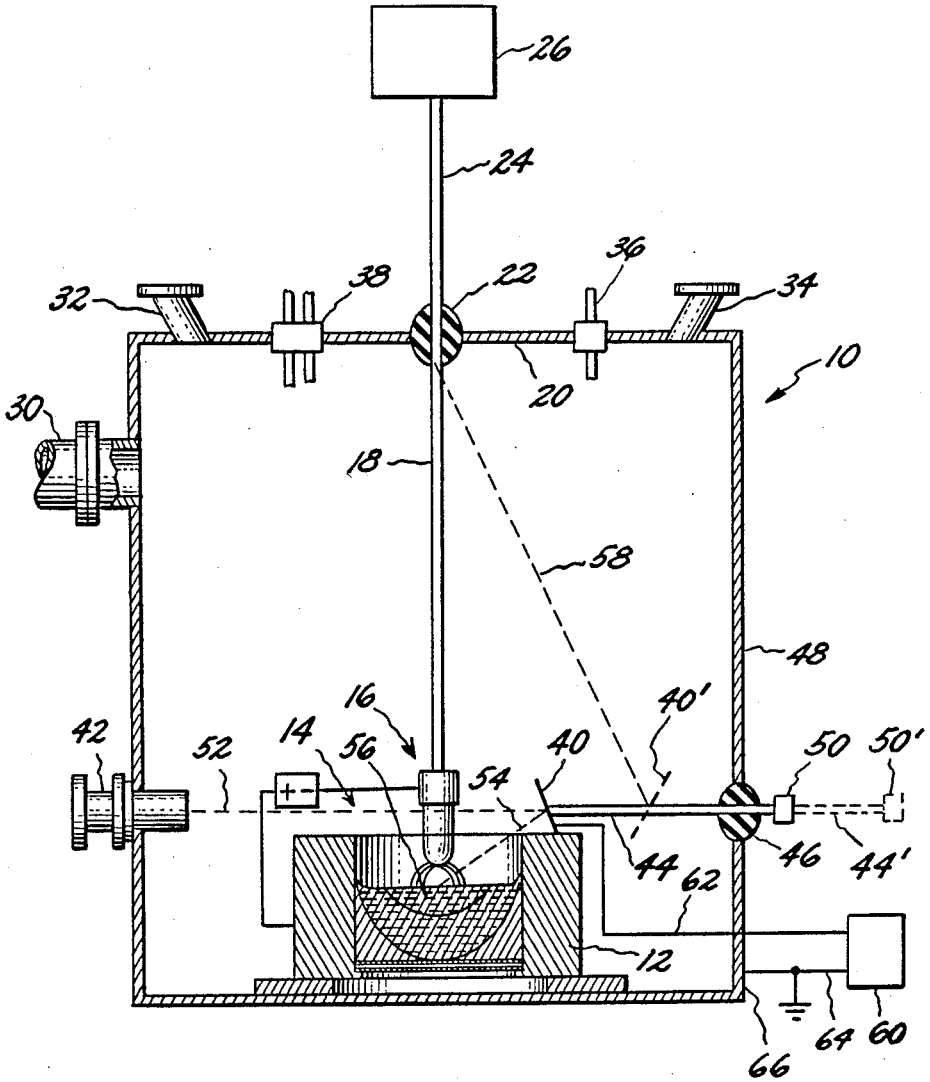
FIG. 1 is a schematic illustration of the interior of a furnace enclosure illustrating a plasma heating of a hearth and the disposition of a charged metal mirror in the enclosure.

One thing that should be understood in the description of the invention which follows and that is that the furnaces and the furnace chamber used in the melt processing of the metals are kept as small as is feasible, consistent with the requirements for operating the furnace. Further, there is a complicated set of processing and sensing equipment which is provided and which must be provided in order for a melt furnace to process the metals which melt at high temperatures through a melt step. For example, although in the Figure only one plasma gun is illustrated frequently more than one gun is employed in order to bring the melt within a crucible to its optimum condition for processing. Further there is additional accessory equipment such as gas inlets and vents and sensing means which must be provided in order to assure optimum processing conditions for a melt within a furnace. Because of the crowded conditions within such a furnace it is not feasible to select an ideal location for any one of the furnace accessories. Rather the various accessories compete for wall space of the furnace enclosure and also compete internally in obtaining the optimum access to the melt for the various functions which the accessories perform.

Considering now the Figure, the Figure is a schematic illustration of a furnace enclosure and accessory equipment. Referring to the Figure an enclosure 10 is provided to enclose a hearth 12 in which a melt 14 is processed by plasma arc heating. The plasma arc is provided from a plasma gun 16 located at the bottom of a support conduit 18 having an outer structural tubular member containing needed gas and electric supply means. The member 18 extends through the furnace wall 20 at a mechanical seal 22 which provides inward and outward motion of the member 18 as well as pivoting motion which permits location of the gun 16 to various zones within the furnace 10. An external portion 24 of the tubular member 18 terminates in a combined gas and electric supply unit 26. As indicated above, more than one torch 16 may be used in connection with a melt processing particularly where the hearth such as 14 is of larger dimensions as for example, an elongated hearth.

In addition to multiple seals such as 22 having members 18 extending therethrough there is auxiliary equipment which is needed for proper furnacing operation. One such apparatus is the vacuum port 30 shown in section. A instrument port 32 may be used to introduce a laser beam into the furnace 10 to measure the level of the metal and the reflected beam may be sensed at an instrument port 34. A gas sampling port 36 permits withdrawal of gas to permit determination of the concentration of gas mixtures in the furnace chamber. Further, a gas supply port 38 permits the introduction of inert gases or reducing gases as the furnacing activity dictates.

In actual operating apparatus there is such a clutter of accessory equipment, particularly at the upper portion of the furnace chamber, that it is sometimes necessary to forego certain types of operations because there is insufficient room to permit the needed accessory equipment to be associated with the furnace.

Turning now to the accessories which are the subject matter of this invention a mirror 40 is provided within the furnace in a position where viewing of the melt surface may be accomplished. Referring now to the Figure a view port 42 is positioned in a sidewall of the furnace at a location opposite and aligned with that of the mirror 40. The mirror is supported from a control rod 44 which rod extends through a seal 46 in sidewall 48 to the handle 50. The handle 50 permits the mirror to be rotated about the axis of the control rod 44. The handle also permits the mirror to be deflected to a greater or smaller angle to the horizontal by conventional motion control means not shown. Further the handle allows the mirror to be withdrawn or moved laterally within the chamber. The mirror is shown in a partially withdrawn position at 40' where the handle is moved to a position indicated at 50' and the control rod is withdrawn to the position indicated at 44'. The movement of the mirror in several manners indicated while still maintaining alignment of the mirror with the viewing line of the viewport 42 permits a great deal of the interior of the furnace chamber to be sighted and examined visually from the viewport 42. Thus the line of sight through the viewport is indicated by the dotted line 52. The reflected line of sight 54 brings the upper surface of the melt 56 into view when the mirror is at the position 40.

However, when the mirror is withdrawn to the position 40' the line of sight remains the same but the reflection seen through the mirror is along the line of sight 58 and the underside of the chamber wall 20 can be examined in this fashion to see whether any deposits have accumulated there to a degree where they may flake off and fall into the melt 56.

A power supply 60 provides a high voltage to mirror 40 through the conductor 62. The conductor 64 from the power supply is grounded to sidewall 66 of furnace enclosure 10. A voltage of 5 to 30 kilovolts is applied to the mirror and the mirror is charged so that a electric field exists around mirror 40 which is the same in sign (positive or negative) as the charge on the particles.

One simple way in which a determination can be made of the charge on the particles is by applying a charge to a plate and observing through a viewport whether particles deposit on the plate or not. The description which follows is presented on the basis that the charge on the particles is negative.

We have found that where a negative charge is applied to a metal surface in an environment in which the PAM or the electron beam is used for high intensity heating of the surface of a melt that the particulate and vaporous material produced from such high intensity heating generally has a negative charge and is attracted to positively charged elements and repelled from negatively charged elements.

Accordingly, pursuant to the present invention a negative charge is applied to a mirrored metal surface to permit the surface to repel the deposit of negatively charged particulate or vaporous material and accordingly to maintain a clear surface and to maintain a clear optical path for light which is incident on the charged metal surface.

The metal of the metal mirror is preferably an inert metal such as one of the noble metals. The noble metal such as gold or platinum can be plated on a smooth metal plate to achieve a highly reflective and conductive surface.

The level of the voltage which is used in connection with the present invention depends on the apparatus in which it is used. For an experimental apparatus a voltage of form 5 kV up to 30 kV could be applied. For industrial scale apparatus higher voltages up to about 80 kV and higher can be employed usefully in improving the optical path with a furnace chamber.

What is claimed is:

1. A method for providing a clear optical path to the interior of a furnace in which high intensity surface heating of metal is in progress which comprises, providing a furnace enclosure, providing a viewport through a wall of said enclosure, providing an articulatable metal mirror surface in said enclosure optically aligned with said viewport of a charge the same as that of said particles, determining the charge on particles from high intensity surface heating of metal in said furnace, providing a high voltage electric source, and applying said high voltage to said metal mirror whereby particulate matter in said furnace is repelled from said metal mirror surface.

2. The method of claim 1 in which the mirror surface is a polished metal surface.

3. The method of claim 1 in which the mirror surface is a noble metal plated on a polished metal plate surface.

4. The method of claim 1 in which the high voltage electric source is up to 30 Kv.

5. The method of claim 1 in which the high voltage electric source is between 5 and 80 Kv.

6. Apparatus for providing an improved optical path through a furnace for high intensity metal heating which comprises, a furnace enclosure adapted for high intensity metal heating, a viewport in a wall of said enclosure, a metal mirror optically aligned with said viewport, and means for impressing a high voltage on said metal mirror.

7. The apparatus of claim 6 wherein the furnace is an electron beam melting furnace.

8. The apparatus of claim 6 wherein the furnace is a plasma spray deposition furnace.

9. The apparatus of claim 1 in which the furnace is a plasma arc melting furnace.

10. The apparatus of claim 1 in which the voltage impressing means has a capacity of up to 30 kv.

11. The apparatus of claim 1 in which the voltage impressing means is capable of impressing a voltage between 5 and 80 kv.

12. The apparatus of claim 1 in which the metal mirror is a gold plated polished plate.

* * * * *